US005468401A

United States Patent [19]

Lum et al.

[11] Patent Number: 5,468,401

[45] Date of Patent: Nov. 21, 1995

[54] CARRIER-FREE METALWORKING LUBRICANT AND METHOD OF MAKING AND USING SAME

[75] Inventors: Andrew F. Lum, La Mirada; Juan M. Uribe, Valinda; John M. Hogan, Long Beach, all of Calif.; Richard A. Persinger, Winfield, Ill.; James F. Miller, Rowland Heights, Calif.; Ramesh A. Navaratnam, Plainfield, Ill.

[73] Assignee: Chem-Trend, Incorporated, Howell, Mich.

[21] Appl. No.: 398,388

[22] Filed: Mar. 3, 1995

Related U.S. Application Data

[63] Continuation of Ser. No. 954,936, Sep. 30, 1992, abandoned, which is a continuation-in-part of Ser. No. 664,169, Mar. 4, 1991, abandoned, which is a continuation-in-part of Ser. No. 367,311, Jun. 16, 1989, abandoned.

[51] Int. Cl.[6] ..... C10M 125/02

[52] U.S. Cl. ..... 252/22; 252/29; 252/30; 72/42

[58] Field of Search ..... 252/23, 28, 29, 252/30; 72/42

[56] References Cited

U.S. PATENT DOCUMENTS

| | | | |
|---|---|---|---|
| 3,888,657 | 6/1975 | Klar et al. | 29/420 |
| 4,071,368 | 1/1978 | Jones | 252/30 |
| 4,106,421 | 8/1978 | Haag et al. . | |
| 4,168,241 | 9/1979 | Kozima et al. . | |
| 4,191,801 | 3/1980 | Jahnke . | |
| 4,228,670 | 10/1980 | Corti et al. . | |
| 4,243,434 | 1/1981 | Hartley et al. | 252/30 |
| 4,256,594 | 3/1981 | Rysek . | |
| 4,308,182 | 12/1981 | Eckard et al. | 252/31 |
| 4,575,430 | 3/1986 | Periard et al. | 252/27 |
| 4,711,733 | 12/1987 | Kanda et al. | 252/29 |
| 4,752,405 | 6/1988 | Kyle et al. . | |
| 4,780,226 | 10/1988 | Sheets et al. | 252/29 |
| 4,788,842 | 12/1988 | Kopp et al. . | |
| 4,808,324 | 2/1989 | Periard et al. . | |
| 4,965,001 | 5/1989 | King | 252/30 |
| 5,006,269 | 4/1991 | Corso et al. . | |
| 5,049,289 | 9/1991 | Jacobs | 252/22 |
| 5,061,389 | 10/1991 | Reichgott . | |
| 5,075,036 | 12/1991 | Parish et al. | 252/511 |
| 5,182,119 | 1/1993 | Edens | 425/222 |
| 5,268,398 | 12/1993 | Nakagawa et al. | 252/22 |

FOREIGN PATENT DOCUMENTS

| | | |
|---|---|---|
| 0169382 | 6/1985 | European Pat. Off. . |
| 0468278A1 | 1/1992 | European Pat. Off. . |
| 1183959 | 7/1959 | France . |
| 57-065795 | 8/1982 | Japan . |
| 62-169899 | 1/1988 | Japan . |
| 2227022 | 7/1990 | United Kingdom . |

*Primary Examiner*—Jacqueline V. Howard
*Attorney, Agent, or Firm*—McAndrews, Held & Malloy, Ltd.

[57] ABSTRACT

A carrier-free pulverulent metalworking lubricant composition. In one preferred form, the composition contains at least two lubricant components one of which comprises a resin having a highly polar functional group the composition being formed by a method comprising the steps of: (a) forming a dry mixture of said particulate lubricant components, and (b) agglomerating said admixture to form agglomerated particles. The application of the composition as a metal working lubricant significantly reduces smoke and oily waste generation in hot forging operations by eliminating the use of oils or volatile organic compounds as carriers, while providing acceptable performance, cleanability, and sprayability.

21 Claims, 10 Drawing Sheets

EXP 2

EXP 3

EXP 4

EXP 5

EXP 6

EXP 7

EXP 8

EXP 9

EXP 10

CARRIER-FREE METALWORKING LUBRICANT AND METHOD OF MAKING AND USING SAME

This is a continuation of application Ser. No. 07/954,936 filed Sep. 30, 1992, now abandoned. which is a continuation-in-part of prior application Ser. No. 07/664,169, filed Mar. 4, 1991, which was a continuation-in-part of prior application Ser. No. 07/367,311 filed Jun. 16, 1989, both now abandoned.

BACKGROUND OF THE INVENTION

This invention relates to the field of metalworking lubricants in general and, in one particular respect, to forging lubricants. More particularly, it relates in one aspect to a new forging lubricant composition and a method of using that composition in the hot forging of metal workpieces. Metal parts of a multitude of sizes and shapes are manufactured by various types of forging operations, and these parts are formed from stock composed of a great many metals and metal alloys. A great many parts are forged from such metals and metal alloys as, for example, steel, aluminum, titanium, and high nickel alloys, to name but a few.

The conditions under which metal parts are forged, of course, are widely variable, depending upon not only the nature of the metal, but upon the size and complexity of configuration of the desired part. Small, thin, simply shaped parts may obviously be forged from a relatively flowable metal such as aluminum under much less rigorous conditions than are required to forge large more complex shaped parts from a metal such as steel.

Each set of forging conditions requires a specialized lubricant, and there is therefore a multitude of aqueous-based, oil-based and organic solvent-based lubricants currently in use in various forging operations. Many such lubricant systems, particularly those used under the most demanding forging conditions, by their nature require the user to make compromises in order to achieve the desired functional characteristics while avoiding as much as possible any safety, occupational health or environmental hazards involved in their use. Moreover, in some instances, more restrictive health and environmental guidelines are now in force which may make the use of certain lubricant systems either extremely expensive or simply unworkable. It is to these and related concerns which the present invention is directed.

In a typical high performance forging operation, such as one which might be devoted to the manufacture of large, complex parts from aluminum alloy stock, an effective lubricant is one which ordinarily contains a variety of lubricity agents in a carrier comprising mineral oil and/or volatile organic solvents. The dies used in such forging operations are maintained at high temperatures, in the range of 350° F. to 825° F. in order to permit proper metal flow during the forging operation.

The forging lubricant is typically applied to the die and the workpiece by spraying, and, on account of the temperatures involved, the mineral oil and volatile organic compounds immediately flash off, leaving only a relatively small amount of residue which actually functions as the lubricant. As anyone who has observed such a forge operation well knows, the flashing off of the mineral oil and volatile organic compounds creates a significant amount of open flames, and the spray wand by which the lubricant is applied takes on the appearance of a flame thrower. Moreover, a large amount of smoke is typically generated when the mineral oil and volatile organic compounds flash off, since, at the same time, a rather significant portion of the lubricity agents may burn off as well. In this context, it is well known that any improvements in the performance of the forge lubricant which are achieved by reformulation frequently come at the cost of significantly higher smoke generation.

Similar difficulties are inherent when oil-based paste type lubricants are utilized. While the paste lubricants contain little or no volatile organic compounds, their oil carriers partially or completely burn at typical forging temperatures, resulting in significant heavy smoke generation.

The hazards, expense and environmental problems associated with such forging operations are of great proportion and are quickly becoming even more so.

In a state such as California, where environmental protection statues and regulations impose rigid standards on industrial operations, and in other states which have similar environmental protection schemes, the smoke generated by a large forge operation creates tremendous difficulties.

Since environmental agencies frequently monitor smoke emissions by aerial surveillance, there is close attention paid to reducing the smoke generated in the forging operation. Unfortunately, this often limits the efforts made to vent the smoke from the buildings in which the forge operation is housed. The result of this is a significant degradation of the air quality within the buildings.

An important economic consideration is that in California, for example, a tax may be levied upon each gallon of volatile organic compounds emitted into the air. More importantly, as air quality standards are progressively raised, there will soon come a time when a forge operation will simply be prohibited from emitting large amounts of smoke. The choice then will be to find an alternative lubricant which produces significantly reduced amounts of smoke or to cease operations entirely.

Similar problems exist with respect to the use of oil or solvent-based lubricants in smaller scale forge and other metalworking operations, since waste lubricant materials of this type are considered an environmental hazard. Disposal is therefore tightly controlled and increasingly expensive.

Other related concerns create a strong demand for alternative metalworking lubricants.

As described above, open flame is generated when conventional mineral oil and volatile organic compound-based lubricants are applied to a heated die. One must therefore have available fire prevention and fire control equipment, such as fire extinguishers and sprinkler systems, in the immediate area of the forge operation. Indeed, fire extinguishers see regular use in many forge operations, and the cost of their maintenance is significant. In general, fire prevention, fire control and fire detection systems of all types are regular and significant capital and maintenance cost items for hot forge operations.

A related problem associated with the use of conventional volatile organic compound-based lubricants is the need for special storage facilities on account of their high flammability. This too imposes a significant cost associated with the use of conventional lubricants.

Transportation of these flammable lubricants in special containers and special vehicles is yet another source of additional cost, hazard, and inconvenience associated with their use.

A still further disadvantage of conventional lubricant systems which results from the flashing off of oil and solvent carriers is that the smoke generated forms tar-like deposits on machinery, finished parts, floors, windows, and nearly everything else housed in the same building with the forge operation. Quite apart from the aesthetic undesirability of such deposits, there are economic and health concerns as well. Many large forge operations maintain permanent steam-cleaning facilities at a significant cost.

Various types of dry lubricants and methods for applying them to metal surfaces have been proposed for use in diverse environments, but none has been widely adopted on account of certain inherent disadvantages in either the lubricant itself or the method of its application.

For example, in titanium forging operations, it has been proposed to utilize a powdered lubricant composed of glass and ceramic components, with the optional use of steel shot, in a process in which the lubricant is imbedded in the forge tool surface by a high pressure spray. This process is described in terms of sandblasting the lubricant onto the tool surface, and is intended to effect a cold working and smoothing of the tool surface. Of course, such a high pressure spray process involves the use of rather expensive spray equipment, and it also presents the risk of worker injury due to misdirected spray.

Others have proposed to spray dry reactant materials onto hot metal surfaces in order to form a reaction product lubricant in situ. Still others have proposed various combinations of dry lubricant components for use in a wide range of applications. Many of these lubricant compositions, however, have drawbacks, as well.

After forging, whether with a conventional or dry lubricant, aluminum parts are subjected to a caustic etch for the purpose of removing lubricant residues. In a preferred procedure which is well known in the art, the caustic etch may be used in combination with an acid wash. In many aluminum forge operations, the acid wash advantageously precedes the caustic etch.

As is well known in the art, the conditions of these wash and etch procedures are quite harsh. Typically, the caustic etch bath is 5% to 15% by weight alkali metal hydroxide in water. Typical acid baths are similarly strong, often containing a high concentration of nitric acid. In forge operations using conventional solvent or oil based lubricants, the wash and etch procedure works quite well to remove essentially all lubricant residues from the forged parts.

Notwithstanding the harsh conditions of the wash and etch, however, it has been found that residues of powdered lubricants may still adhere to the parts with such tenacity that even subjecting the parts to physical removal procedures, such as brushing and scraping, after the etch will not adequately clean them.

It has also been found, in working with multi-component powdered lubricants, that obtaining a consistent spray pattern using conventional powder coating equipment is extremely difficult. Overspray, underspray, puffing, and sputtering have been found to be serious drawbacks, both from the standpoint of obtaining a functional lubricant coating on the workpiece and from the standpoint of efficient use of powder lubricant material. Overall, the spray process has heretofore been found too erratic to be acceptable commercially. Moreover, it has been unexpectedly found that the spray was particularly unpredictable when utilizing powder coating equipment which, as is quite common, utilizes a fluidized bed as a reservoir from which the powder was sprayed. Even utilizing powder coating equipment which has a gravity-fed reservoir has typically provided only a marginal improvement in consistency.

While the particular problems encountered in an aluminum forge operation have been described in detail, many of the same and other related concerns exist in other metal working environments. These include not only other hot forge operations, such as the manufacture of forged steel and titanium parts, but also a wide variety of other metalworking and metal forming operations. Examples include extrusion, drawing, stamping, and other hot and cold forming operations, many of which employ lubricants in aqueous or solvent based carriers. Thus, many of the same technical and economic benefits could be realized in such operations by adopting an improved dry lubricant composition.

It is therefore a principal object of the present invention to provide a forge lubricant and a method of its use which significantly reduce the amount of smoke and oily waste generated during the forging operation.

A related object is to eliminate the organic carrier materials which are essential parts of conventional high performance forging lubricants. Thus, a general object of the present invention to provide a lubricant which eliminates many health, environmental and safety drawbacks of conventional lubricants having mineral oil and volatile organic compounds as carriers.

Another more particular object is to eliminate the need for special transportation and storage facilities which are required for conventional lubricants.

A further important object of the present invention is to provide a powdered lubricant composition which may be applied to a workpiece and/or die in a substantially uniform coating by the use of conventional powder coating equipment.

A related object is to provide a method of manufacturing a powdered lubricant composition which may be more readily applied to a workpiece and/or die in a substantially uniform coating by the use of conventional powder coating equipment.

Yet another important object is to provide a high performance dry lubricant which does not form residues which resist removal by conventional cleaning procedures.

Other objects and advantages of the present invention will be apparent to those skilled in the art from the following description of the invention and the appended claims.

SUMMARY OF THE INVENTION

In its most basic form, the composition of the present invention is a carrier-free pulverulent metalworking lubricant, i.e., one which is entirely free of the oils and volatile organic compounds commonly employed as carriers for forge lubricant compositions. Similarly, in one form, the method of the invention is a method of forming a workpiece in a metal-forming apparatus which includes the steps of applying to at least one of the metal-forming apparatus and the workpiece a coating of an effective amount of a carrier-free pulverulent lubricant composition, and forming the workpiece in the apparatus.

The carrier-free pulverulent metalworking lubricant of the invention may, in general, include any material which will provide lubricating properties at the temperatures typically encountered in a forging process and which can be put into a physical form which permits it to be applied to the die and/or the workpiece by conventional powder-coating equipment.

In accordance with the present invention, the need to incorporate a mineral oil and/or a volatile organic compound-based carrier is completely eliminated, with the result that the smoke generated by conventional lubricants is significantly reduced.

In one form, the invention is a carrier-free pulverulent metalworking lubricant composition including at least one resin having a highly polar functional group, which may be solubilized under strong acid or basic conditions, and which is a solid at room temperature.

In another aspect, the invention is a carrier-free metalworking lubricant composition having a substantially uniform particle size.

Yet another aspect of the invention is a method of forming a carrier-free pulverulent metalworking lubricant composition, which includes the steps of forming a dry admixture of lubricant components, heating the admixture to a temperature sufficient to melt at least one component of the admixture, agitating the heated admixture to form a substantially homogenous melt, cooling the substantially homogenous melt to form a substantially solidified mass, and comminuting the substantially solidified mass to a desired particle size. In an alternative aspect, the invention is a method of forming a homogeneous melt of lubricant components and then spray-drying the melt to a desired particle size.

In yet another aspect, in which the melting step is eliminated, the present invention is directed to a method of forming the carrier-free pulverulent metalworking lubricant comprising the steps of forming a dry admixture of the particulate components, and agitating the admixture whereby agglomerated particles of a carrier-free pulverulent metalworking lubricant are formed. Preferably, the method further includes the step of adding a binder to facilitate the adherence of the particles to one another. More preferably, the binder is an aqueous based solution; most preferably the binder is an aqueous solution that includes a thickener and/or a surfactant.

A still further aspect of the invention is a method of forging a workpiece in a die which includes the steps of applying to at least one of said die and said workpiece a coating of an effective amount of a carrier-free pulverulent lubricant composition having at least one resin having a highly polar functional group, which may be solubilized under strong acid or basic conditions, and which is a solid at room temperature, and forging the workpiece in the die.

The advantages inherent in the composition and methods of the present invention are numerous. In particular, the elimination of much of the smoke previously generated by the flashing off of a mineral oil and volatile organic compound carrier permits a forging operation to continue in business in full compliance with environmental statutes and regulations. Moreover, the business may continue without the economic burden of tax payments based on the emission of volatile organic compounds. In many instances, the use of the composition and method of the present invention will permit a forge operation to continue in existence under a stringently regulated environmental scheme which would otherwise cause it to be shut down entirely.

Other economic advantages of the composition and method of the invention are of equally great importance. The reduction in weight and volume which occurs when the carriers of conventional lubricants are eliminated leads to savings in the cost of shipment and storage. Even further savings are realized in transportation and storage costs because the carrier-free composition of the invention is neither flammable nor hazardous, and it can be shipped and stored in the same manner as any other nonhazardous material. Moreover, packaging costs are significantly reduced, since a five-gallon plastic pail of the carrier-free pulverulent metalworking lubricant of the present invention will be the functional replacement for a fifty-five gallon steel drum of a conventional lubricant.

In the forge operation itself, the composition and method of the invention result in significant reductions in the cost of installing and maintaining fire prevention and fire control systems, and in general permit the maintenance of a much safer environment for personnel at a much lower cost.

Still further savings resulting from the use of the composition and method of the invention may be realized in reduced premiums for fire, workmen's compensation, and liability insurance.

The elimination of the carrier material significantly reduces raw material cost, since, on a weight and volume basis, the carrier in conventional lubricants accounts for well over 80% of the composition.

The need to maintain expensive and space-consuming cleaning facilities for plant and finished parts is also reduced by the use of the composition and method of the invention, since significantly less combustion residues will be produced in the absence of the flashing off of mineral oil and volatile organic compound carriers.

Additional functional advantages are also achieved by the present invention.

The incorporation of a resin which is solubilized in an alkali and/or acid bath provides the advantage of a cleanable forged part, even with the use of a dry powder lubricant.

Further, maintaining the particle size of the lubricant powder within a narrow range permits a uniform coating of lubricant powder to be applied with conventional powder coating equipment, even when utilizing equipment which employs a fluidized bed as a powder reservoir. And, controlling the particle size of the lubricant powder by its novel method of manufacture not only provides spray consistency, but improves lubricant properties and cleanability as well.

DETAILED DESCRIPTION

Figure 1:
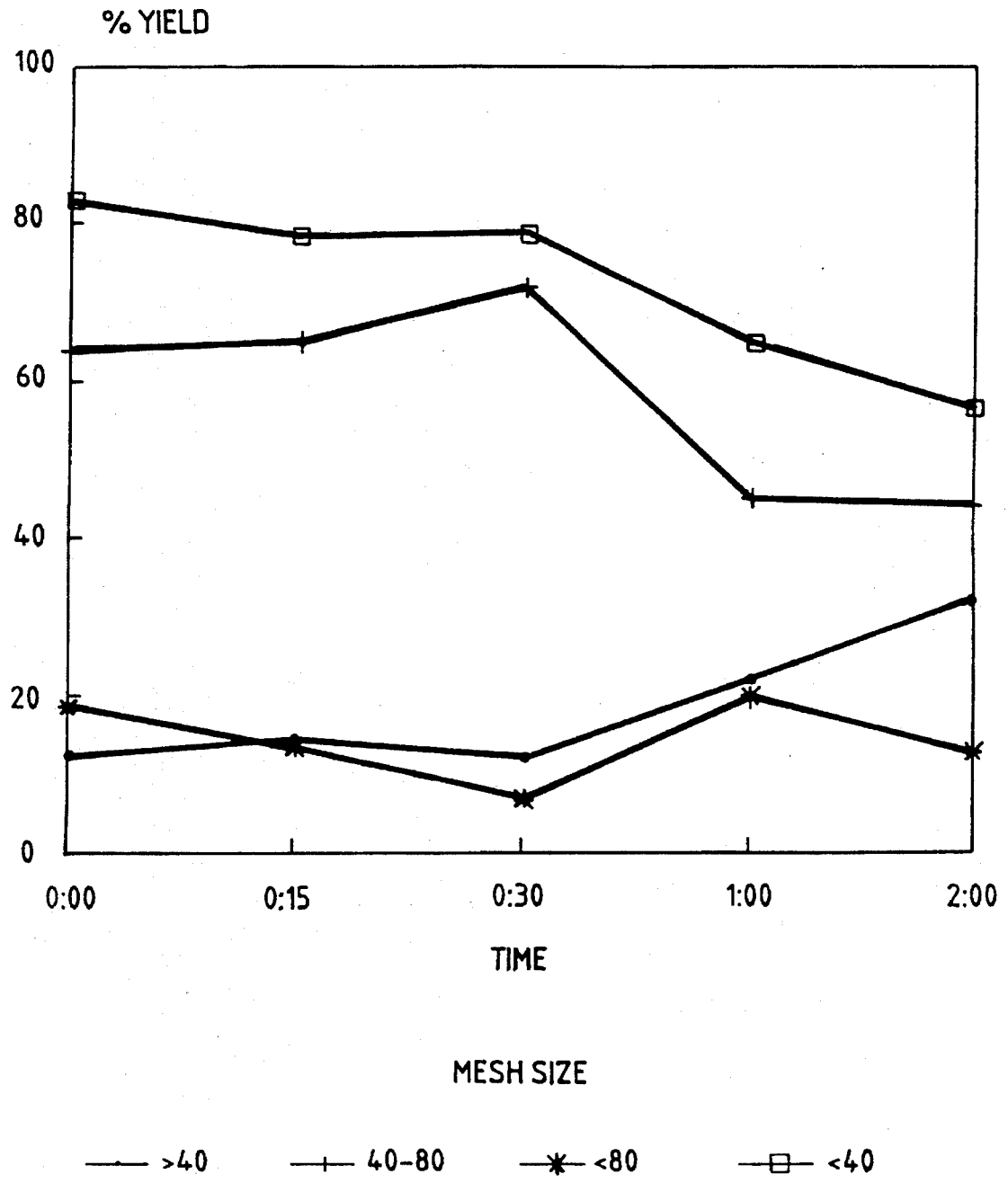
FIG. 1 is a graphical representation of the change in particle size distribution over time during the process of Example 23.

As stated above, the composition of the present invention, in its most basic form, is a carrier-free pulverulent metalworking lubricant. It may include any material which will provide lubricating properties at the temperatures typically encountered in a metal-forming process and which can be put into a physical form which permits it to be applied to the die and/or the workpiece by conventional powder-coating equipment.

Many materials which will perform the function of lubricating the die and maintaining a physical separation between the die and the workpiece are well known, and, of these materials, many are in the physical form necessary to the practice of the present invention; namely, a solid at room temperature. It is not necessary that the materials employed in the composition of the invention remain either solid or pulverulent at the temperatures typically encountered during a hot forging operation, e.g., about 600° F. up to 1000° F. for aluminum, and about 1500° F. up to 2500° F. for steel or titanium. It is enough that they may be made to exist in a particulate form at ambient temperatures. In that form, they can be applied by conventional powder-coating equipment, even though they may partially or completely melt or burn when in contact with the heated die or workpiece. Indeed, it is preferred that at least one component of the carrier-free pulverulent metalworking lubricant becomes sticky upon being heated so as to assist in adhering the dry metalworking lubricant composition to the workpiece and die surfaces.

Typical materials which are capable of maintaining a physical barrier between the die and the workpiece and which function as solid lubricants are contemplated for use in the composition of the invention. They include, by way of example only, metal soaps, fatty acids, graphite, ceramics, high melting polymer resins, natural and synthetic waxes, gilsonite, glasses, and mixtures of these materials.

Useful metal soaps are those which are solids at room temperature, including many sulfonates, naphthenates, and carboxylates. Of these, fatty acid soaps such as zinc stearate and sodium stearate are preferred on account of their known properties, their ready availability and low cost. However, other metal soaps known for their lubricant properties, including, by way of example only, tin, copper, titanium, lithium, calcium, and other alkali and alkaline earth metal soaps of fatty acids, may be advantageously included.

Fatty acids themselves which are solids at room temperature may also be included, and their relatively low cost, ready availability, and their contribution to the overall lubricity of the composition makes them attractive for such use. One example is stearic acid, which is advantageously used since it has good lubricating properties, is nontoxic, inexpensive, and readily available.

Materials such as graphite and certain ceramic materials such as boron nitride are useful for maintaining a physical separation between the die and the workpiece. While the precise mechanism of the physical separation is not known, this characteristic is believed to be attributable to the relatively planar crystalline structure of these materials.

Useful high melting polymer resins include, by way of example, poly(tetrafluoroethylene) (PTFE), high density polyethylene (HDPE), poly(vinylchloride) (PVC), polyesters, polyethylene glycols, polyacrylates, polymethacrylates, and polyamides. Indeed, almost any thermoplastic material may be used.

It is believed that the thermoplastic resins of the invention provide a plastic matrix on the heated metal surfaces within which the individual lubricant components may be supported during metal forming. As is well known, thermosetting resins, such as phenolic resole resins typically lose the ability to flow following heating. The ability of thermoplastic resins to remain plastic throughout the metal forming process is believed to be an important characteristic of the polymer resin components of the lubricant of the invention.

Of the natural and synthetic waxes which may be advantageously employed, polyethylene waxes of relatively high molecular weights are in general preferred on account of the lubricity which they impart.

Glass materials useful in the present invention are preferably the low melting glasses, including alumina, alumina/silica, silica, and borax. Optionally, these glass materials may be used in chopped fiber form.

In one basic form of the method of the invention, a coating of an effective amount of a carrier-free pulverulent lubricant composition is applied to at least one of the die and the workpiece, and the workpiece is then formed into the desired finished part. In general, the application of the lubricant in accordance with the invention may be accomplished by any conventional powder-coating equipment.

In one alternative method falling within the scope of the present invention, the carrier-free pulverulent metalworking lubricant is applied by means of an electrostatic spray apparatus, inasmuch as there is little loss of material on account of the electrostatic attraction of the particles to the die and/or workpiece, and, since electrostatic spray is known to produce a uniform coating on even complex-shaped parts.

In high temperature environments, such as aluminum, steel, and titanium forging operations, maintaining sufficient charge on the lubricant particles is quite difficult when the powder spray is directed to the die or workpiece in the vicinity of the press, and the electrostatic powder coating apparatus provides little advantage over non-electrostatic equipment. However, an electrostatic apparatus provides a significant benefit for pre-coating aluminum, steel, or titanium workpieces at ambient temperature, after which the workpiece is heated in an oven prior to insertion into the press. Similarly, in cold forming operations, such as stamping and the like, which are carried out at much lower temperatures, the advantages of electrostatic spray are maintained.

The lubricant of the invention may be applied to a heated or heating die in a manner analogous to the application of conventional lubricants. Alternatively, the lubricant composition may be sprayed onto a cold unforged workpiece, after which the workpiece is heated to achieve a partial melt of the composition and subsequently placed into a heated die for forging. In cold-forming operations, the workpiece may be spray-coated, and the conventional step of heating the workpiece to flash off or evaporate an aqueous solvent or oil carrier may be eliminated.

It has been found that on account of their very powdery, even dust-like, nature, such materials as graphite and amorphous boron nitride are, unless they have an electrostatic charge, less easily retained on the surfaces of the die and workpiece than are some of the other materials enumerated above. Drafts or currents of air may therefore undesirably remove the pulverulent forging lubricant from the die and/or the workpiece prior to the forging operation. Thus, when including one or more of these materials in a lubricant of the invention formed as a dry admixture which is to be delivered by a non-electrostatic powder coating apparatus, it is preferred to also include at least one component having adhesive properties at typical forging temperatures, such as a glass, gilsonite, or high melting polymer resin for the purpose of retaining the lubricant on the die and the workpiece.

Some examples of the lubricant composition and metal-working method of the invention are set forth below.

EXAMPLES 1 AND 2

The following compositions were used to forge a box channel with high walls, approximately 0.125 inches thick, in a wrap die from aluminum alloy stock. The press was of the hydraulic type, with the workpiece temperature being 700° F. and the die temperature 375° F:

Example 1

| Component | Weight % |
|---|---|
| gilsonite | 5 |
| zinc stearate | 34 |
| sodium stearate | 10 |
| graphite | 17 |
| polyethylene | 34 |
| | 100 |

Example 2

| Component | Weight % |
|---|---|
| gilsonite | 5 |
| zinc stearate | 34 |
| sodium stearate | 10 |
| graphite | 17 |
| amide wax | 34 |
| | 100 |

Only seven parts were forged; thus, optimization of spray techniques could not be achieved. However, examination of the forged parts showed excellent metal movement, with a complete die fill of the walls of the channel. There was excellent downsize of the critical part dimension, and the parts released easily from the die, with no sticking. The dies had some tendency to stick together; however, this is normally experienced with this configuration of parts. Smoke levels were noticeably lower than those produced when a conventional solvent, oil and graphite lubricant was used. Based on this rather limited trial, the composition of Example 1 outperformed the composition of Example 2 in each of the observed respects, though both were effective as forging lubricants.

Example 3

In a comparative trial, the composition of Example 1 was evaluated using a conventional solvent-based zinc stearate forging lubricant as a standard. The press was of the mechanical type, with the workpiece temperature being 700° F. and the die temperature 400° F.

Forty parts were forged from each composition. Examination of the forged parts showed excellent metal movement with no drag. There was excellent downsize of the critical part dimension. The parts released easily from the die, with no sticking, and there was no buildup of lubricant residue on the parts. Smoke levels when using the composition of Example 1 were significantly lower than those produced during the trials reported in Examples 1 and 2.

EXAMPLES 4 AND 5

Each of the following compositions was evaluated under the same conditions as those of Example 3, and each was found to perform satisfactorily with significantly lower smoke generation than conventional solvent-based lubricants.

Example 4

| Component | Weight % |
|---|---|
| graphite | 33.0 |
| zinc stearate | 34.5 |
| gilsonite | 10.9 |
| polyethylene wax | 21.1 |
| | 99.5 |

Example 5

| Component | Weight % |
|---|---|
| graphite | 23.8 |
| sodium stearate | 33.4 |
| gilsonite | 23.8 |
| polyethylene wax | 9.5 |
| zinc stearate | 9.5 |
| | 100.0 |

The composition of Example 5 was also evaluated in the high-temperature environments of steel and titanium forging, and it was found to perform satisfactorily in the forging of both metals.

EXAMPLES 6–8

The following carrier-free pulverulent lubricant compositions have also been found useful for the forging of aluminum and aluminum alloy workpieces:

Example 6

| Component | Weight % |
|---|---|
| graphite | 23.8 |
| sodium stearate | 33.4 |
| gilsonite | 23.0 |
| polyamide | 9.5 |
| zinc stearate | 9.5 |
| | 100.0 |

Example 7

| Component | Weight % |
|---|---|
| graphite | 23.8 |
| sodium stearate | 33.4 |
| gilsonite | 23.8 |
| polyacrylate | 9.5 |
| dibutyl tin carbonate | 9.5 |
| | 100.0 |

Example 8

| Component | Weight % |
|---|---|
| graphite | 75 |
| gilsonite | 25 |
| | 100.0 |

Example 9

| Component | Weight % |
|---|---|
| graphite | 50 |
| sodium stearate | 15 |
| gilsonite | 25 |
| poly (tetrafluoroethylene) | 10 |
| | 100.0 |

EXAMPLES 10–15

Other carrier-free pulverulent lubricant compositions have been found useful for high temperature forging of titanium and steel, and they include the following:

Example 10

| Component | Weight % |
|---|---|
| graphite | 20.0 |
| gilsonite | 20.0 |
| sodium stearate | 30.0 |
| stearic acid | 20.0 |
| polyethylene wax | 10.0 |
| | 100.0 |

Example 11

| Component | Weight % |
|---|---|
| graphite | 15.0 |
| gilsonite | 20.0 |
| sodium stearate | 30.0 |
| stearic acid | 20.0 |
| polyethylene wax | 10.0 |
| boron nitride | 5.0 |
| | 100.0 |

-continued

Example 12

| Component | Weight % |
|---|---|
| graphite | 40.0 |
| gilsonite | 20.0 |
| sodium stearate | 20.0 |
| stearic acid | 20.0 |
| | 100.0 |

Example 13

| Component | Weight % |
|---|---|
| alumina/silica glass | 40.0 |
| graphite | 60.0 |
| | 100.0 |

Example 14-1

| Component | Weight % |
|---|---|
| boron nitride | 25.0 |
| borax | 75.0 |
| | 100.0 |

Example 14-2

| Component | Weight % |
|---|---|
| graphite | 35.0 |
| borax | 65.0 |
| | 100.0 |

In one particular application; namely, the forging of steel engine valves, a number of advantages were realized by employing a lubricant of the following composition:

Example 15

| Component | Weight % |
|---|---|
| graphite | 20.0 |
| gilsonite | 5.0 |
| polyethylene wax | 70.0 |
| powdered sulfur | 5.0 |
| | 100.0 |

In this particular application, the composition of Example 15 outperformed the composition of Example 5 in a number of respects. In particular, better metal flow was achieved, resulting in the elimination of crack formation; improved part configuration was observed; and, better die life was achieved. Though the precise mechanism which resulted in these improvements is not known, it is believed that the sulfur particles become molten on the die and workpiece surfaces, and that the molten sulfur provides added lubricity and enhances the extreme pressure properties of the dry lubricant composition. It is further believed that the sulfur promotes the formation of carbon sulfides and other lubricant residues which function as parting media, enabling the forged part and the die to separate cleanly.

Addition of sulfur to the composition in an amount of from about 2% to about 30% by weight provides the benefits described above, while an amount in the range of from about 5% to about 20% is preferred for functional and economic reasons.

It is possible to achieve a limited improvement in cleanability of aluminum and aluminum alloy parts by reducing or eliminating gilsonite from the composition, since it tends to contribute to the formation of tar-like residues on the forged parts. But eliminating this component improves cleanability only marginally, and at the price of reduced performance, since the gilsonite provides good lubricity, while at the same time its tacky character at forging temperatures tends to help a lubricant formed as a dry admixture to adhere to the workpiece and the die.

What has been discovered to be extremely effective, however, is to replace the gilsonite with a component which unexpectedly provides the combination of the same desirable performance attributes contributed by gilsonite and other similar tacky substances, together with a level of cleanability which is the equal of a conventional solvent and/or oil based forging lubricant.

Specifically, the use of a resin component having certain physical and chemical attributes can provide the combination of good performance and far superior cleanability required for successful industrial use.

In general, any resin which has good lubricity properties at forging temperatures, is a solid at ambient temperatures, and contains a highly polar functional group which enables the resin to be solubilized in the caustic etch and/or acid bath will provide this combination of properties. In general, halogenated resins are preferably avoided in hot forging operations on account of their tendency to form hazardous combustion products.

Particular resins which have been found useful in the practice of the invention include the polyethylene glycol resins, polyester resins having terminal hydroxyl or carboxyl functional groups, polyacrylate, polymethacrylate, and polyamide resins and mixtures of these resins.

It is further believed that the thermoplastic resin components of the invention contribute to the ease with which these lubricants can be cleaned from the parts, following metal forming. As is well known, thermoplastic resins which have oxygen linkages in the polymer backbone provide reactive sites for acid or base attack which, in turn, provides a ready mode by which the resin may be broken down and solubilized. Breakdown of the long chain polymer during post-formation cleaning of the workpiece in acidic or basic solvents may assist the removal of the other lubricant components as well, since the resin ordinarily tends to adhere the other components to the workpiece.

Presently preferred are the polyester and polyethylene glycol resins on account of their good lubricity properties, superior cleanability, and lack of objectionable burn characteristics. Some examples of such resins are the polyethyleneglycol resins sold under the tradename Pluracol by BASF, such as E4000 and E8000, the hydroxyl functional polyester resins sold by Cargill, such as 30-3016, and the carboxyl functional polyester resins sold by Cargill, such as 30-3065. These materials are generally dry solids at room or ambient temperature, so that they are readily applied to the workpiece and die by conventional powder coating equipment.

These resins provide the desired combination of lubricity and cleanability characteristics when utilized in the carrier-free lubricant composition of the invention in amounts of from about 5% to about 50% by weight of the composition, with a preferred range of from about 10% to about 30% by weight of the composition. Most preferably, the amount of resin is maintained as low as possible while still providing the desired performance characteristics, since these resins tend to be more expensive on a weight unit basis than many of the other components of the composition. While, in general, an observable improvement in cleanability is achieved when at least about 5% by weight of the composition is a high-melting resin having a highly polar functional group, the upper concentration limit is more an economic than a functional one.

It is important to note in this regard (and with respect to the determination of the optimum concentration of any of the other components of the composition) that small variations in the amount of resin used do not manifest themselves in readily observable variations in performance or cleanability. Indeed, the evaluation of performance and cleanability is highly subjective and not susceptible to quantification to any meaningful degree. Thus, the weight percentage of resin or any other component in the lubricant composition is not narrowly critical to the practice of the present invention and may vary considerably without an adverse effect on performance.

EXAMPLE 16

A lubricant powder composition was formulated in accordance with the invention as follows:

| Component | Weight % |
|---|---|
| graphite | 15 |
| stearic acid | 15 |
| zinc stearate | 30 |
| sodium stearate | 10 |
| polyethylene glycol | 20 |
| carboxyl functional | 10 |
| polyester | |
| | 100 |

The lubricant so formulated was successfully utilized in a high performance aluminum forge operation for the purpose of forging a number of aircraft parts. The lubricant of Example 16 was further found to perform successfully in typical steel (engine valves) and titanium (turbine blades) forging operations.

EXAMPLE 17

The forging of a first group of aluminum parts using the composition of Example 16 was carried out together with the forging of a second group of aluminum parts using the composition of Example 5, and a series of three comparative cleaning tests was conducted. The cleaning procedures and the results obtained are summarized below:

CLEANING TESTS DETAIL

Test A - Process (Standard Etch)

Step 1 - Caustic soda, 8 oz/gal, 175°–180° F., 120 sec.
Step 2 - Rinse, cold.
Step 3 - Rinse, cold.
Step 4 - Desmut, nitric acid 25%, 60 sec.
Step 5 - Rinse, cold.
Step 6 - Rinse, cold.
Step 7 - Rinse, hot.

Results:

Removing Example 5 lubricant: poor cleaning.

Removing Example 16 lubricant: marginally acceptable cleaning.

Test B - Process:

Step 1 - 24% sulfuric acid, 6% nitric acid, 180° F., 10 min.
Step 2 - Rinse, cold.
Step 3 - Rinse, cold.
Step 4 - Caustic soda, 8 oz/gal, 175°–180° F., 120 sec.
Step 5 - Rinse, cold.
Step 6 - Rinse, cold.
Step 7 - Desmut, nitric acid 25%, 60 sec.
Step 8 - Rinse, cold.
Step 9 - Rinse, cold.
Step 10 - Rinse, hot.

Results:

Removing Example 16 lubricant: essentially clean; equivalent to cleaning liquid lubricant with standard etch process.

Test C - Process:

Step 1 - Nitric acid 50%, 120 sec.
Step 2 - Rinse, cold.
Step 3 - Caustic soda, 8 oz/gal, 140° F., 30–180 sec.
Step 4 - Rinse, cold.
Step 5 - Desmut, nitric acid 50%, 120 sec.
Step 6 - Rinse, cold.
Step 7 - Rinse, hot.

Results:

Removing Example 16 lubricant: essentially clean; equivalent to cleaning liquid lubricant with the same etch process.

Following a number of such comparative cleaning tests, a still further advantage of the lubricant of Example 16 over a conventional zinc-containing lubricant was discovered; namely, a 95% reduction in the amount of zinc present in the etch solutions. Reduction of the metal content of industrial wastes is, of course, a valuable environmental and economic benefit.

EXAMPLES 18–21

Lubricant powder compositions also formulated in accordance with the present invention are:

Example 18

| Component | Weight % |
|---|---|
| graphite | 15 |
| stearic acid | 20 |
| dibutyl tin carboxylate | 20 |
| sodium stearate | 25 |
| polyamide | 10 |
| hydroxyl functional polyester | 10 |
| | 100 |

Example 19

| Component | Weight % |
|---|---|
| graphite | 15 |
| carboxyl functional polyester | 20 |
| sodium stearate | 20 |
| stearic acid | 20 |
| polyethylene glycol | 10 |
| boron nitride | 5 |
| | 100 |

Example 20

| Component | Weight % |
|---|---|
| graphite | 40 |
| hydroxyl functional polyester | 20 |
| zinc stearate | 20 |
| stearic acid | 20 |
| | 100 |

Example 21

| Component | Weight % |
|---|---|
| alumina/silica glass | 40 |
| graphite | 55 |
| polyethylene glycol | 5 |
| | 100 |

It was determined that maintaining a narrow particle size range for the carrier-free pulverulent lubricant of the present invention would provide greatly improved spray efficiency and consistency, such that a substantially uniform coating of powder lubricant was capable of being applied to the workpiece. Thus, in another aspect, the present invention is directed to a carrier free pulverulent lubricant composition wherein the particles are of substantially uniform size.

By the phrase "substantially uniform size" as used herein is meant that there be relatively few or no particles having a size, as measured by "diameter," more than 50% larger nor 50% smaller than the mean particle size. Most preferably, relatively few or no particles of the lubricant powder have a particle size that is more than 10% larger or more than 10% smaller than the mean particle diameter.

Substantially uniform sized lubricant particles, having a mean particle size (i.e., diameter) within the range of 10 microns to 420 microns produced acceptable results. However, a mean particle diameter of 40 microns or greater is preferred. This lower size limit was selected to minimize the extent to which lubricant particles remain airborne in the form of dust. There are two objectives in minimizing dusting; namely, to provide an environmentally safer environment for the worker, and to reduce lubricant material loss by increasing the efficiency and accuracy of the powder spray. The upper limit on particle size is essentially a function of the capability of the spray equipment and of the ability of the particles to adhere to the surface of the workpiece in a substantially uniform coating. The commercially available powder coating equipment that was used herein seemed to function best with particles ranging in size from 50 microns to 100 microns.

One manner of controlling both mean particle size and the range of particle sizes is to utilize, as starting materials, lubricant components that have been ground and/or sieved to a substantially uniform size. The sieved components may then be readily admixed by conventional dry mixing techniques, such as by use of a ribbon blender, a tumbling blender, or a twin shell blender, such as manufactured by Patterson-Kelly Co., East Stroudsburg, Pa. An obvious drawback of the dry mixing procedure is the time, effort, and expense involved in either purchasing or processing each of the components to the desired size and size range. A second drawback is that the dry blending process itself causes the particles to abrade one another, thereby creating a multitude of small particles which once again broadens the particle size range. Further difficulties also arise in lubricants manufactured by this method; namely, segregation of the lubricant particles on account of differences in particle size and weight of the various components, unacceptable levels of dusting on account of the presence of very fine particles, and, poor flowability.

A second method for preparing a carrier-free pulverulent lubricant composition, having particles of a substantially uniform size, involves hammer milling a solidified melt phase of the lubricant composition. Specifically, it has been discovered that a high performance powdered lubricant having particles of a substantially uniform size may be formed by the following method: First, the lubricant components, which may be in any conveniently available comminuted form, such as powders, flakes, small pellets, and the like, essentially regardless of their particle size, are admixed in the desired proportions to form a dry lubricant premix. The dry lubricant premix is then heated with agitation to form an essentially homogenous melt. A temperature of from about 100° C. to about 200° C. is usually sufficient to provide a consistency which permits melt mixing. The homogenous melt is then cooled to form a solid mass. The solid mass is then ground at low temperature to the desired particle size by conventional cold-grinding techniques. Equipment capable of performing this operation is commercially available. In one such process, the homogenous lubricant melt is discharged onto a rotating metal plate which is chilled to about 40° F. (10° C.) to solidify the mass in sheet form. The sheets are then broken into shards which are in the range of 1 to 3 centimeters across. The shards are then, in turn, hammer-milled to the desired particle size in an air-conditioned room. Other similar processes solidify the melt into ribbon form, after which it is broken into chips and milled to the desired particle size under suitable conditions. Hammer milling the melt phase overcomes a shortcoming of the drymixing method, i.e., controlling the particle size, and may also achieve other significant improvements, by forming the lubricant powder in an entirely different manner.

Typically, the hammer milling equipment is rather massive, and is constructed of steel or another metal. If the equipment is conditioned to the ambient room temperature, i.e., about 60° F. to 70° F., it provides a highly efficient heat sink for the lubricant composition as it is milled. If necessary, the apparatus can be further chilled by, for example, circulating liquid nitrogen through a network of internal channels provided for that purpose. Even simply pouring liquid nitrogen into the intake hopper of a conventional grinder along with the lubricant material is an effective, albeit rudimentary, cooling method. This temperature control permits optimization of the process in terms of controlling particle size, since many of the lubricant components would become tacky or semi-solid upon being subjected to the heat generated in conventional grinding or milling processes, but remain dry solids at lower temperatures.

Manufacturing the lubricant composition in this manner avoids the undesirable results of the dry mix method in that it produces a lubricant powder which has a much more narrow particle size distribution, which has better flowability on account of the more uniform particle size, and which produces little or no dust.

The lubricant powder produced by the melt mixing process is physically different, as well, since the individual particles are of heterogenous composition. Visual examination of the lubricant particles produced by the melt mixing process shows that the meltable components fuse to form a solid matrix in which the non-melting components (e.g., graphite) are fixed. This matrix structure, in which discrete particles of non-melting components are fixed in a matrix of the meltable components, is clearly visible under 20:1 to 100:1 magnification on account of the color differences among the lubricant components.

While the melt-mixing and grinding process is effective in overcoming many of the deficiencies of the dry mix process, that effectiveness comes at the cost of a significantly more complicated and expensive multi-step process. Moreover, the process has functional drawbacks as well. On the one hand, the typical equipment used to melt mix the lubricant components; namely, a vessel heated by an oil-filled jacket, cannot produce temperatures high enough to melt certain metal soaps (e.g., tin soaps) which are quite desirable components of the lubricant composition. On the other hand, typical grinding or milling equipment (unless operated in a cooled environment or unless supplied with an integrated chilling system) heats the lubricant composition to the point at which some low-melting components (e.g., waxes) become tacky and can no longer be processed as powders.

Alternatively, the lubricant of the invention may be produced by forming a homogenous melt of the components as described above, and then spray-drying the melt in a conventional manner to the desired particle size to produce heterogeneous particles having a matrix structure much like that of the particles produced by the melt mix and grind process described above.

Not only do these processes of producing the lubricant of the invention greatly facilitate controlling the particle size of the composition, which optimizes the process of applying it to the die and workpiece, but they produce improvements in the performance of the lubricant composition. Since the lubricant particles are ground or spray-dried from an essentially homogenous mass, the lubricant components are far more evenly distributed in the composition than could be accomplished using conventional dry mixing techniques.

A third method for preparing a carrier-free pulverulent lubricant composition wherein the particles are of a substantially uniform size is wet granulation. In the wet granulation method, the lubricant components are premixed, such as in a Patterson-Kelly granulator or V mixer, until a homogeneous mixture is obtained. Thereafter a sufficient amount of an aqueous binder is added to the homogeneous mixture to produce a slurry. The binder may contain thickening agents, such as polyvinylpyrrolidone (ISP Technologies/GAF, Wayne, N.J., PVP K-Series, e.g., K30 (MW=40,000), K60 (MW=160,000), K90 (MW=360,000) or hydroxymethyl cellulose (e.g., QP 300 cellosize, Union Carbide Corp., Danbury, Conn.), which upon drying forms a bridge between adjacent particles. Optionally, the binder may also contain one or more non-ionic surfactants, preferably from 0.1% to 0.3% by weight, such as diisopropyl adipate (Van Dyke Ceraphyl 230); octyldodecylstearoyl stearate (Ceraphyl 847); or a polyoxyethylene ether e.g., Triton N-101 (Triton® is a registered trademark of Rohm and Haas Co.) A variety of polyoxyethylene ethers are commercially available under the Triton mark from Sigma Chemical Co., St. Louis, Mo. The slurry is poured onto cookie sheets and allowed to dry in an oven preferably set at about 210°–220° F. The dried slurry is broken up into chips, ground into lubricant particles of heterogeneous composition and segregated according to particle size. Segregation is accomplished sequentially be passing the ground particles through 40 mesh and 80 mesh filters and retaining the lubricant particles that pass through the 40 mesh filter but that are retained by the 80 mesh filter. The retained particles provide a carrier-free pulverulent composition wherein the lubricant particles are of a substantially uniform size.

A fourth method for preparing a carrier-free pulverulent lubricant composition having particles of substantially uniform size is agglomeration. Agglomerating the particulate lubricant components to form agglomerated particles of heterogeneous composition has proven advantageous in that the previously mentioned melt step and slurry step, and their accompanying shortcomings, may be eliminated altogether. Various techniques for agglomerating particles are known to the art. See for example, Ulmann's Encyclopedia of Industrial Chemistry, VCH Publishers, NY, N.Y. 1988 at Vol. B-2 pp. 7-1 to 7-37, which is incorporated herein by reference.

The process for forming the agglomerated lubricant particles may be carried out in either the presence or absence of a binder; preferably in the presence of a binder; more preferably, an aqueous binder; most preferably, an aqueous binder containing a polymeric binding agent (i.e., "thickener") and/or a non-ionic detergent. For purposes of this invention, the phrase "aqueous binder" is meant to include any binder solution wherein more than 50% of the solvent is water, preferably more than 75%, and more preferably greater than 90%. The balance of solvent in the aqueous based solution is a non-interfering water miscible organic solvent. Typical water miscible organic solvents include alcohols having from 1 to 3 carbon atoms, polyols, such as ethylene or propylene glycol, or glycerine, polyethylene glycols having a molecular weight ("MW") from 200–600, acetone, tetrahydrofuran (THF), dimethylsulfoxide (DMSO) and the like. Other water miscible organic solvents are well known to those of ordinary skill in the art. For many such solvents, however, care must be taken to avoid buildup of static electricity in the equipment which could provide a source of ignition.

Binder components that may effectively be used to adhere the component lubricant particles in the agglomeration process of the present invention include natural gums or products including algin, starch, and xanthan gum; cellulose derivatives, including methyl cellulose, hydroxylpropylmethyl cellulose and glyoxal hydroxymethyl cellulose; polymers, including polyvinylpyrrolidone (PVP), and sodium carboxymethyl starch; compressibility enhancers including microcrystalline cellulose and bentonite; and matrix binders, such as corn syrup, waxes, sorbitol, paraffin, shellac alcohol, and polymethacrylate. Many other chemical binders are also available. Binder components may be chosen based upon a number of factors, including the type of agglomeration, viscosity, concentration, bond strength and drying characteristics.

Agglomerating in the presence of a binder permits many individual particles of differing composition, size, and surface characteristics to coalesce and adhere to one another to form larger particles comprised of the various component particles. The strength and size of the resulting agglomerated particles is dependent upon the binding characteristics of each individual component particle, the binder characteristics, and the method of agitation.

In the present invention, the various particulate components are selected based upon their performance in a heterogeneous pulverulent metal working lubricant composition. From an economic standpoint, it is desirable to utilize the agglomeration process of the present invention to form the (heterogeneous) carrier-free pulverulent metalworking lubricant composition. The various component particles may be purchased in the appropriate particle size ranges to facilitate controlling the particle size range of the carrier-free pulverulent lubricant composition.

Depending upon the relative size of the component particles, agglomeration may be described as a coalescence between equal size particles, a layering of a larger granule with smaller particles or an absorption of still smaller particles by a partially filled binder droplet.

While it is possible to calculate rough relationships between the amount of binder, the agitation intensity and the process duration, selecting the optimum parameters requires routine experimentation with each particular piece of agglomerating equipment. Agglomerating equipment that may be useful in forming the agglomerated particles of the invention include drum and disk blenders, pinmixers, spray-dryers, compactors, and fluidized bed or spouted bed granulators.

In a typical drum blender agglomeration process, the agglomeration can be expressed as a function of the dimensionless Stokes number (Stv), which is given by the equation:

$$Stv = \frac{2mu_o}{3Ua^2} = \frac{8pu_oa}{9U} = \frac{16pa^2w}{9U}$$

Where m=mass of the particle (mg)

U=Fluid binder viscosity (cps)

a=particle radius (microns)

p=particle material density (g/m$^3$)

w=drum rotational speed (rpm)

$u_o$=relative particle velocity=2 aw (for drum granulation) (m/s)

Normally, a distribution of particle sizes is encountered in a one component system. In a multiple component particle system, wherein the various component particles may have a variety of configurations, surface contours, radii, masses and densities, some experimentation is required to achieve an effective agglomeration. The two variables that are most readily adjusted are the fluid binder viscosity (U) and the relative particle velocity ($u_o$) attributable to the rate of agitation.

In Examples 22–32 which follow, a carrier-free pulverulent metalworking lubricant having a substantially uniform size was prepared by agglomeration using either a laboratory scale or a commercial scale "V" or twin-shell liquid-solids blender/granulator (Patterson-Kelly Co., East Stroudsburg, Pa.) hereafter "the granulator." This granulator performs batch process agglomeration. However, continuous process agglomeration equipment may also be used. In the agglomeration process, the particulate components of the lubricant composition were added to the chambers of the granulator and dry blended for sufficient time to assure a homogeneous mixture. Thereafter, while the granulator was still drymixing, the binder solution was added all at one time. The commercial scale twin-shell blender utilized in certain of the examples was modified to permit excess moisture to escape during processing. The modification consisted of drilling small holes of about ¼" diameter into the tops of the cover plates, covering the holes with filter paper of sufficient pore size to allow air to escape while retaining substantially all of the fines, and pumping relatively dry air through the liquid dispersion bar to reduce the moisture content of the agglomerated particles therein.

It is desirable to keep the moisture of the product as low as possible both during agglomeration, to prevent caking, and afterwards to both avoid conditions conducive to microbial growth and, more importantly, maintain the lubricant in a free-flowing state which permits effective application by powder-coating equipment. In accordance with the present invention, the moisture content of the agglomerated metalworking lubricant is preferably below 15% by weight following processing; more preferably, below 2%; most preferably, below 0.5%. Optionally, anti-caking agents, such as silica, tricalcium phosphate, calcium aluminum silicate, and microcrystalline cellulose may be added in an amount of up to about 10% by weight to improve the flow characteristics of the agglomerated particles.

For the examples which follow, the following were used: graphite 3731, average particle size 50 microns, available from Superior Graphite as SF33; sodium stearate, average particle size less than 325 mesh, available from Witco Chemical; zinc stearate, average particle size less than 325 mesh, available from Witco Chemical.

| | Raw Material | % by Weight |
|---|---|---|
| | Particulate Components | |
| 1 | Graphite 3731 | 14.50 |
| 2 | Sodium Stearate | 24.00 |
| 3 | Cargill 30-3065 | 9.60 |
| 4 | Pluracol E-4000 | 19.23 |
| 5 | Zinc Stearate | 28.80 |
| | Binder Components | |
| 1 | Water | 3.67 |
| 2 | QP300 Cellosize (hydroxymethyl cellulose) | 0.16 |
| 3 | Triton N-101 (a non-ionic surfactant) | 0.04 |
| | | 100.00% |

The above-listed binder components were premixed in the recited proportions until they became clear and thick. The premix was then set aside. The particulate components were added to the agglomerator in a dry state in the order in which they are listed, and were dry blended for one half hour. The binder was then poured into the agglomerator, taking care that it did not hit the walls or the sweep bar. The agglomerator contents were then agitated at a drum rotational speed of 15 rpm for four hours. Thereafter, the resulting agglomerated particles were separated according to size by being passed through a 40 mesh screen and then through an 80 mesh screen. The substantially uniform particles of the carrier-free pulverulent metalworking lubricant of the present invention passed through the 40 mesh screen, but were retained by the 80 mesh screen. In terms of relative particle size, this means that the substantially uniform particles have diameters in the range of about 170 microns to about 420 microns. Agglomerated carrier-free lubricant particles in this size range carried well to the surface of the metal with a minimum of dusting.

EXAMPLES 23–32

Examples 23–32 set forth the particle size distribution of the lubricant composition as a function of time for 3 lb. batches (Examples 23–29), or 200 lb. batches (Examples 30–32). Examples 23–32 use the same particulate components 1–5 listed in Example 22 but vary the quantity and composition of the binder solution. FIGS. 1–10, which correspond to Examples 23–32, graphically compare the particle size distribution as a function of agglomeration time. The particle distribution at time zero reflects the particle size distribution after mixing but prior to the addition of the binder. As Example 24 reflects, there is a higher distribution of oversized particles at time zero if the raw particles are not ground prior to agglomeration. The highest yield of ideal sized particles was obtained as described in Example 32.

Example 23 (see FIG. 1)

| | No Binder Size: 3 lbs. | | | | |
|---|---|---|---|---|---|
| Distribution | 0 | 15 min. | 30 min. | 60 min. | 120 min. |
| Oversize (+40 mesh) | 12% | 14% | 12% | 22% | 33% |
| Ideal (+80 –40 mesh) | 64% | 65% | 72% | 45% | 44% |
| Undersize (–80 mesh) | 18.5% | 13% | 6.8% | 20% | 13% |

Figure 2:
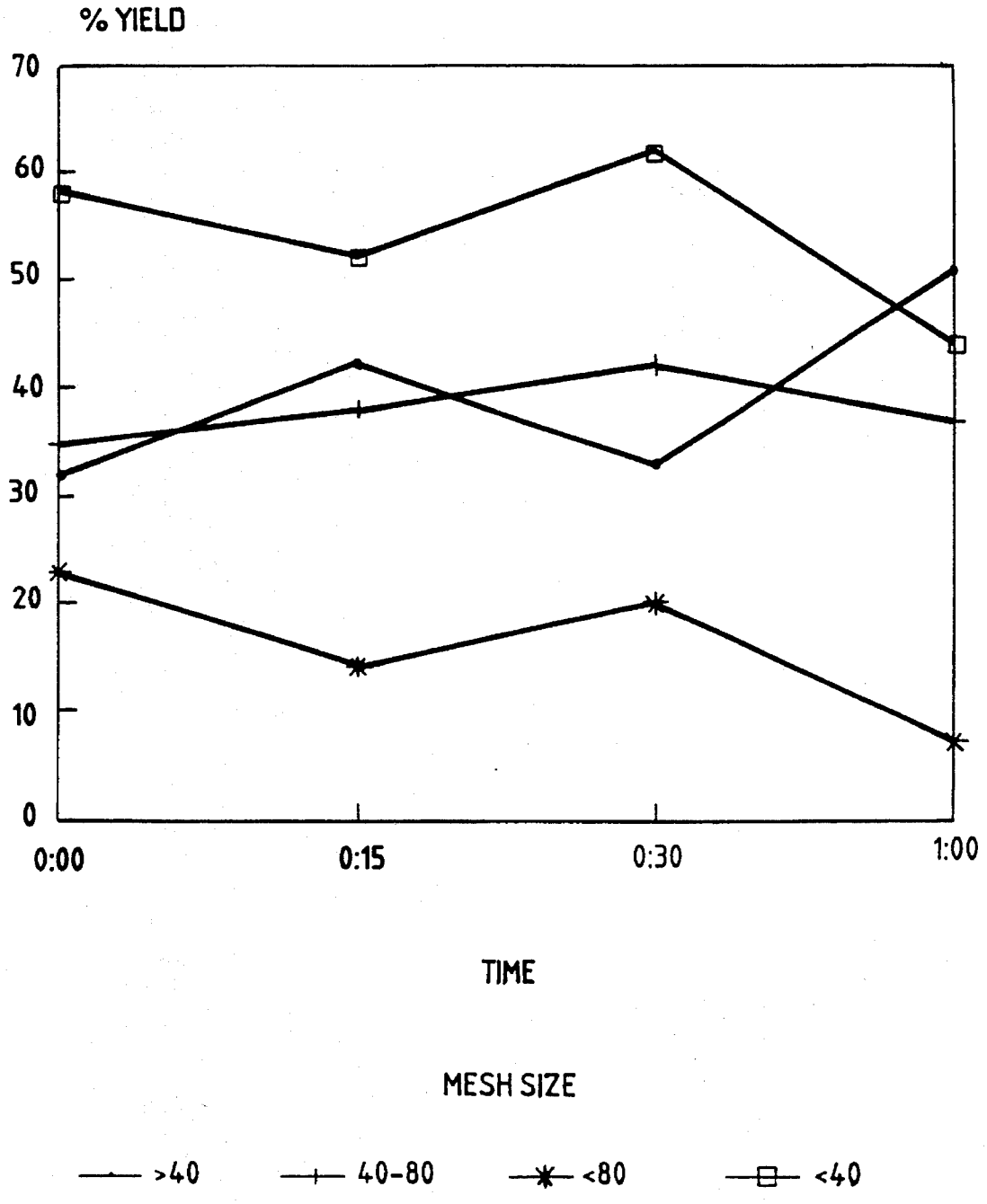
FIG. 2 is a graphical representation of the change in particle size distribution over time during the process of Example 24.

Example 24 (see FIG. 2)

| Binder: 5% by weight; Binder composition: $H_2O$. Raw panicles, i.e., unground. Size: 3 lbs. | | | | | |
|---|---|---|---|---|---|
| Distribution | 0 | 15 min. | 30 min. | 60 min. | 120 min.[1] |
| Oversize (+40 mesh) | 32% | 42% | 33% | 51% | |
| Ideal (+80 –40 mesh) | 35% | 38% | 42% | 37% | |
| Undersize (–80 mesh) | 23% | 14% | 20% | 7% | |

[1]No data; Experiment interrupted.

Figure 3:
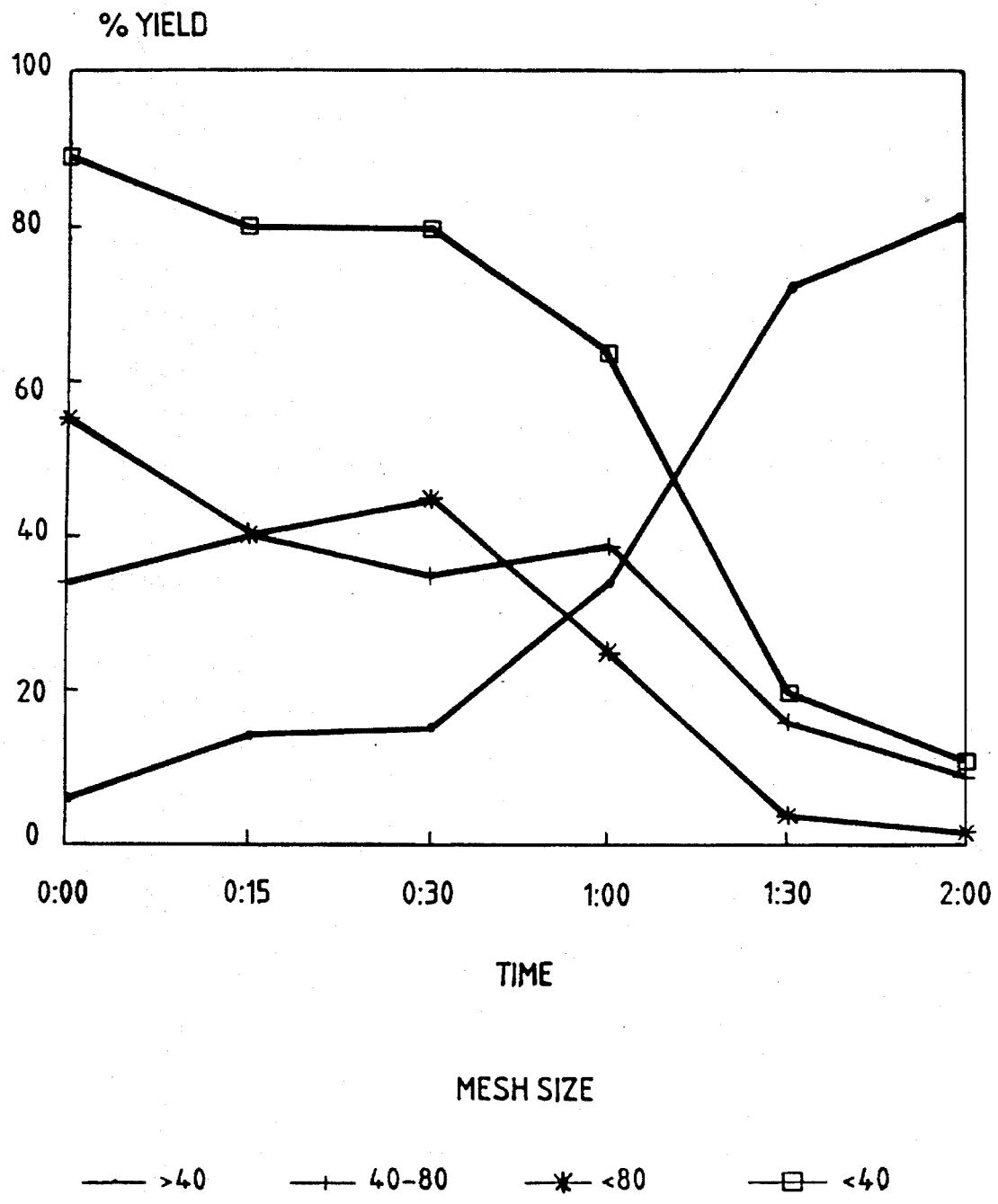
FIG. 3 is a graphical representation of the change in particle size distribution over time during the process of Example 25.

Example 25 (FIG. 3)

The raw particles were first ground with 5% $H_2O$ by wt.
Size: 3 lbs.

| Distribution | 0 | 15 min. | 30 min.[2] | 60 min. | 90 min. | 120 min. |
|---|---|---|---|---|---|---|
| Oversize (+40 mesh) | 6% | 14% | 15% | 34% | 72% | 82% |
| Ideal (−40 +80 mesh) | 34% | 40% | 35% | 39% | 16% | 9% |
| Undersize (−80 mesh) | 55% | 40% | 45% | 25% | 4% | 2% |

[2]Added 2% $H_2O$ for a total of 7% $H_2O$

Figure 4:
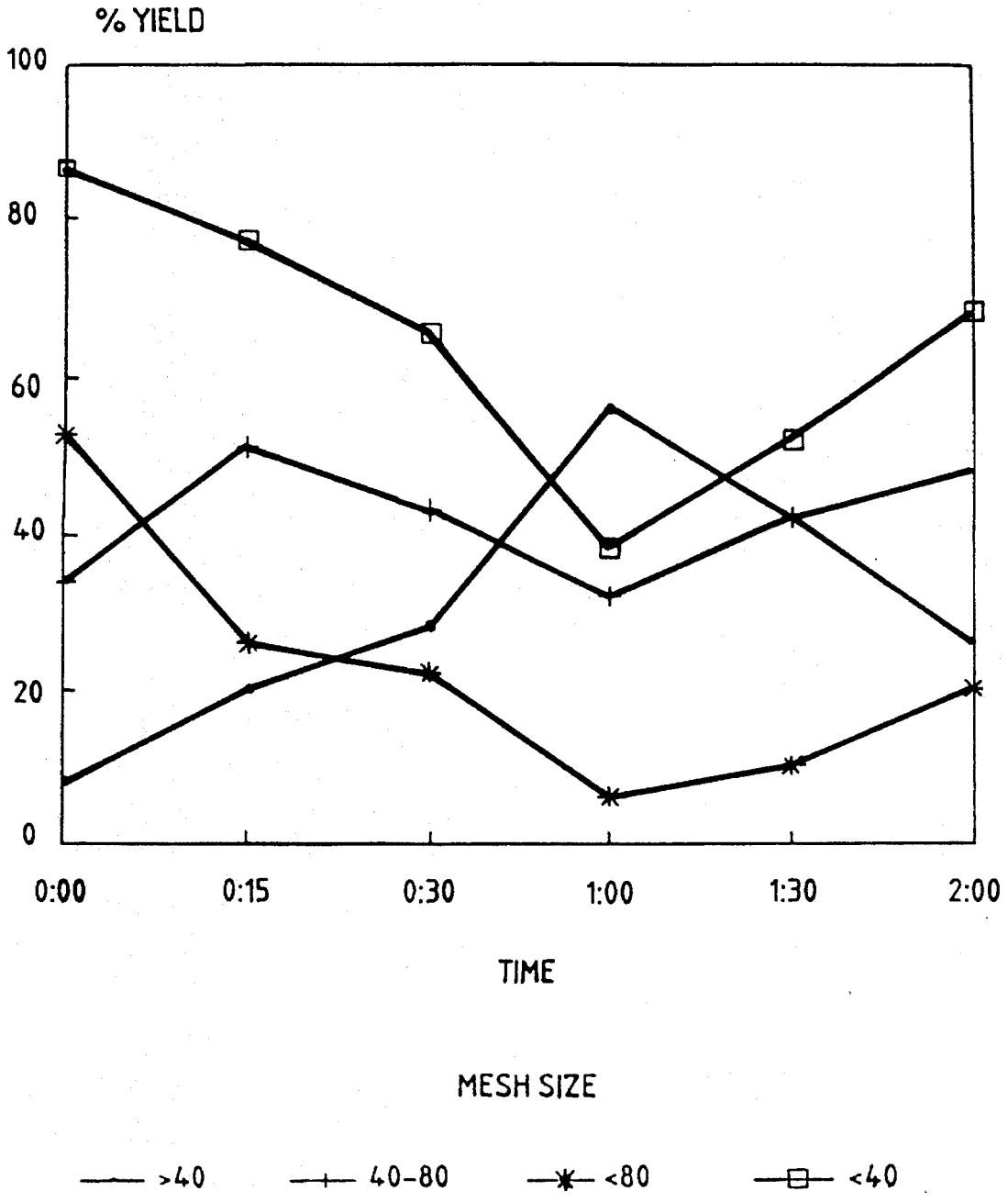
FIG. 4 is a graphical representation of the change in particle size distribution over time during the process of Example 26.

Example 26 (FIG. 4)

Binder: 5% by weight;
Binder composition: 5% poiyvinylpyrrolidone ("PVP")
MW - ?, 95% $H_2O$ (v/v).
Size: 3 lbs.

| Distribution | 0 | 15 min. | 30 min. | 60 min. | 90 min. | 120 min. |
|---|---|---|---|---|---|---|
| Oversize (+40 mesh) | 8% | 20% | 28% | 56% | 42% | 26% |
| Ideal (−40 +80 mesh) | 34% | 51% | 43% | 32% | 42% | 48% |
| Undersize (−80 mesh) | 52% | 26% | 22% | 6% | 10% | 20% |

Figure 5:
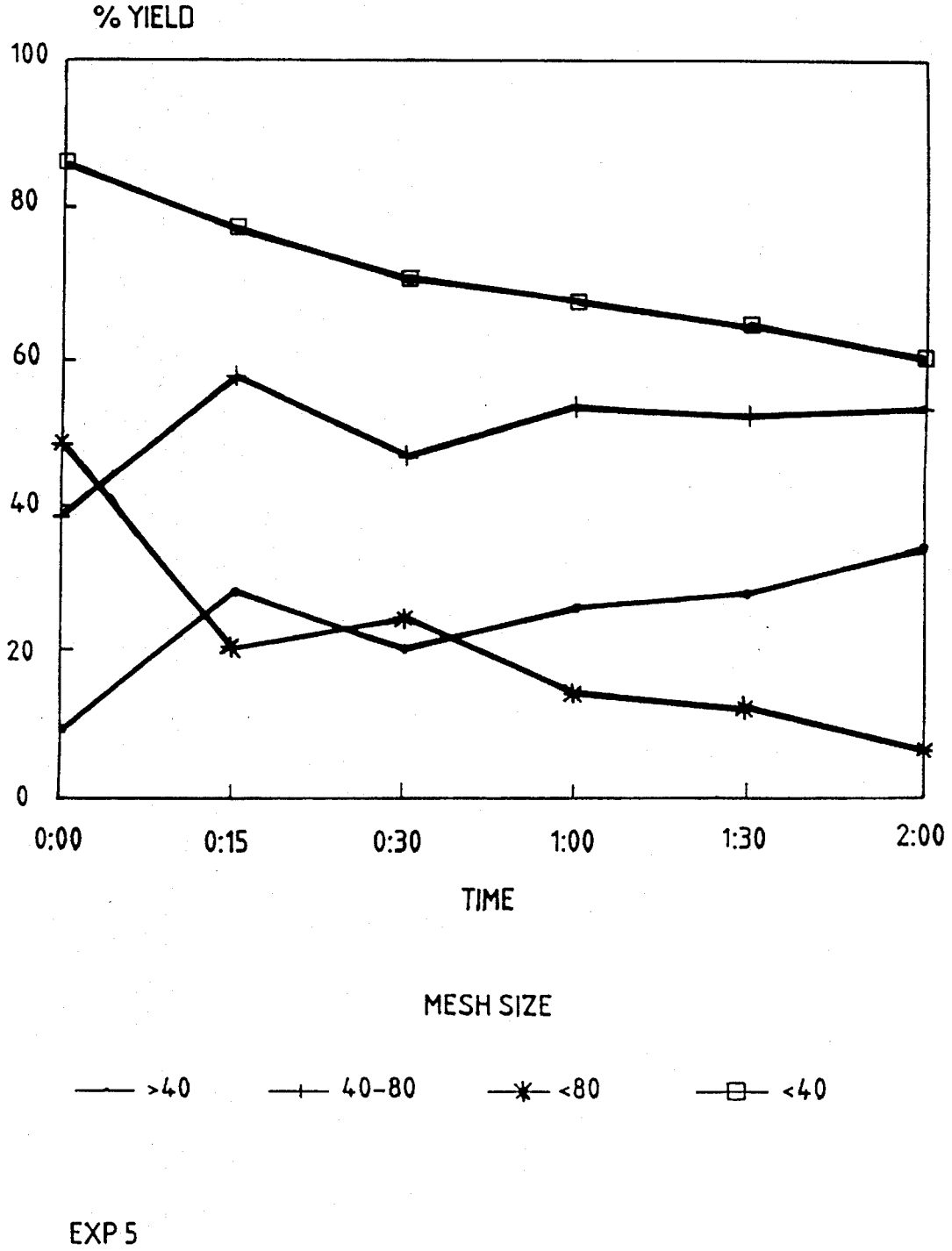
FIG. 5 is a graphical representation of the change in particle size distribution over time during the process of Example 27.

Example 27 (FIG. 5)

Binder: 5% by weight; Binder composition:
3% QP300 glyoxal hydroxymethylcellulose solution, 0.1%
Triton N101, 96.9% $H_2O$ (v/v).
Size: 3 lbs.

| Distribution | 0 | 15 min. | 30 min. | 60 min. | 90 min. | 120 min. |
|---|---|---|---|---|---|---|
| Oversize (+40 mesh) | 9% | 28% | 20% | 26% | 28% | 34% |
| Ideal (−40 +80 mesh) | 38% | 57% | 46% | 53% | 52% | 53% |
| Undersize (−80 mesh) | 48% | 20% | 24% | 14% | 12% | 7% |

Figure 6:
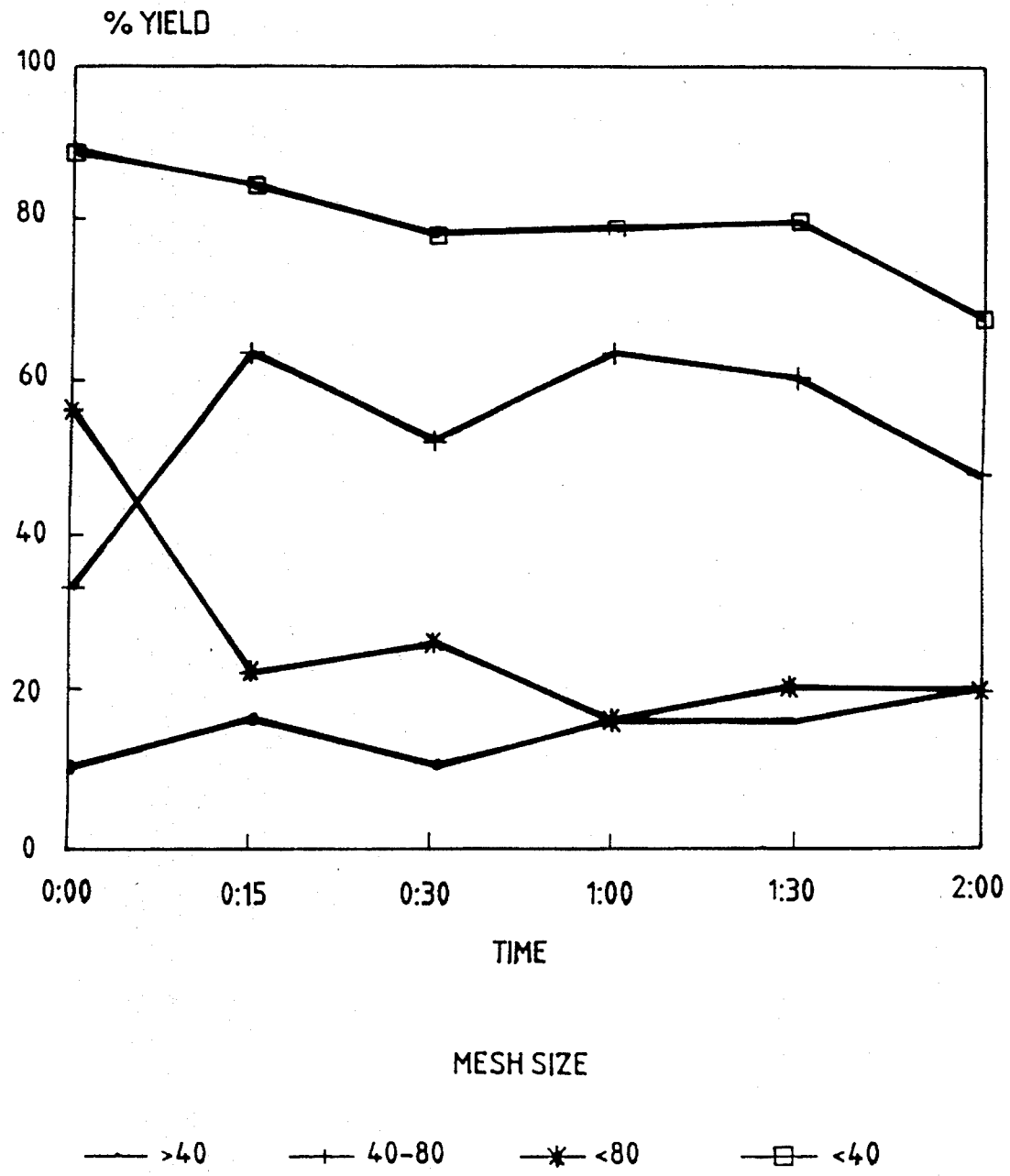
FIG. 6 is a graphical representation of the change in particle size distribution over time during the process of Example 28.

Example 28 (FIG. 6)

Binder: 5% by weight; Binder composition:
5% diisopropyladipate (i.e., Van Dyke Ceraphyl 230), %
$H_2O$ (v/v).
Size: 3 lbs.

| Distribution | 0 | 15 min. | 30 min. | 60 min. | 90 min. | 120 min. |
|---|---|---|---|---|---|---|
| Oversize (+40 mesh) | 10% | 16% | 10% | 16% | 16% | 20% |
| Ideal (−40 +80 mesh) | 33% | 63% | 52% | 63% | 60% | 48% |
| Undersize (−80 mesh) | 56% | 22% | 26% | 16% | 20% | 20% |

Figure 7:
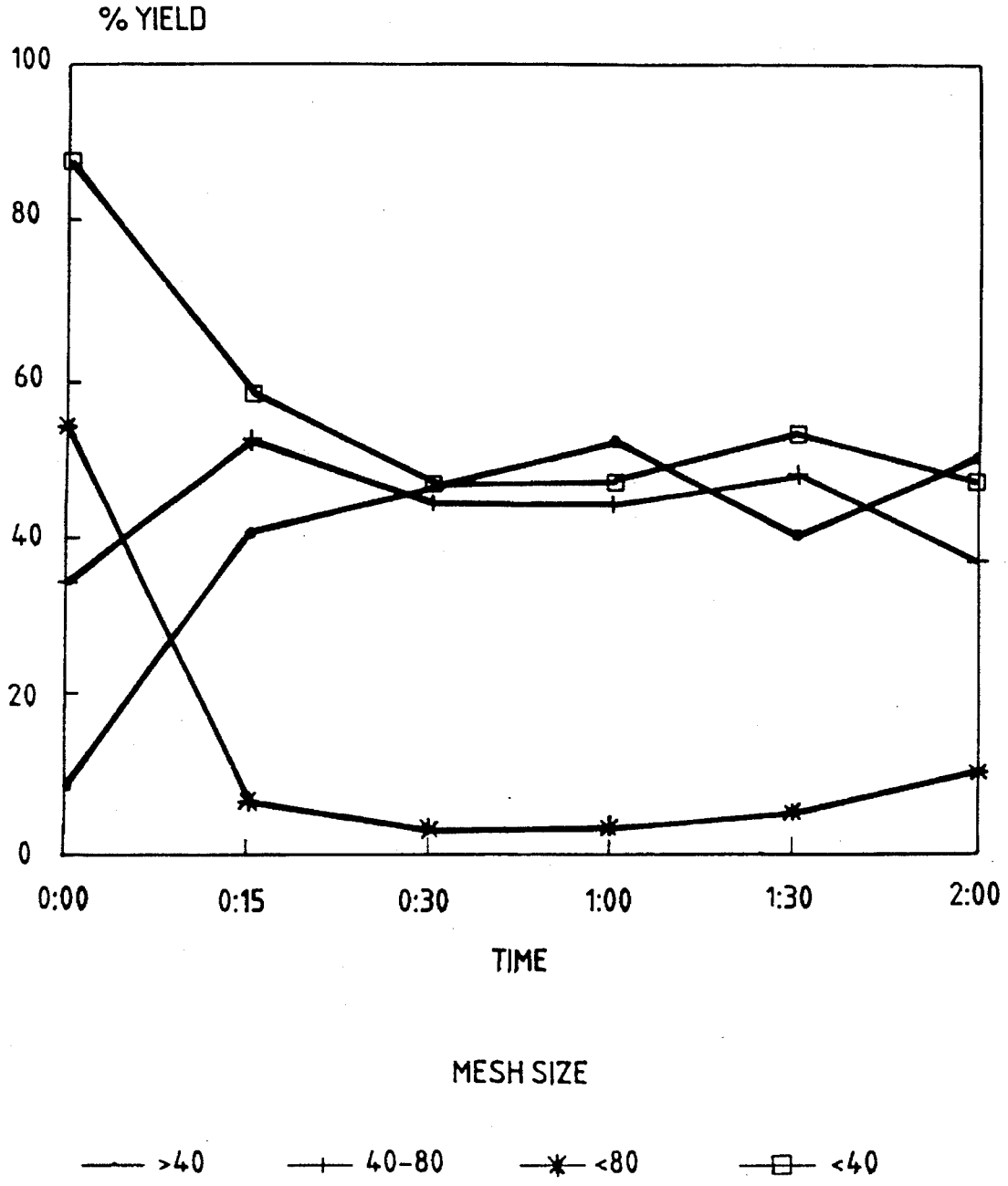
FIG. 7 is a graphical representation of the change in particle size distribution over time during the process of Example 29.

Example 29 (FIG. 7)

Binder: 5% by weight; Binder composition:
5% oetyldodecyl steroyl stearate (i.c., Ceraphyl 847) %
$H_2O$ (v/v).
Size: 3 lbs.

| Distribution | 0 | 15 min. | 30 min. | 60 min. | 90 min. | 120 min. |
|---|---|---|---|---|---|---|
| Oversize (+40 mesh) | 8% | 40% | 46% | 52% | 40% | 50% |
| Ideal (−40 +80 mesh) | 34% | 52% | 44% | 44% | 48% | 37% |
| Undersize (−80 mesh) | 54% | 6.0% | 2.6% | 3% | 5% | 10% |

Figure 8:
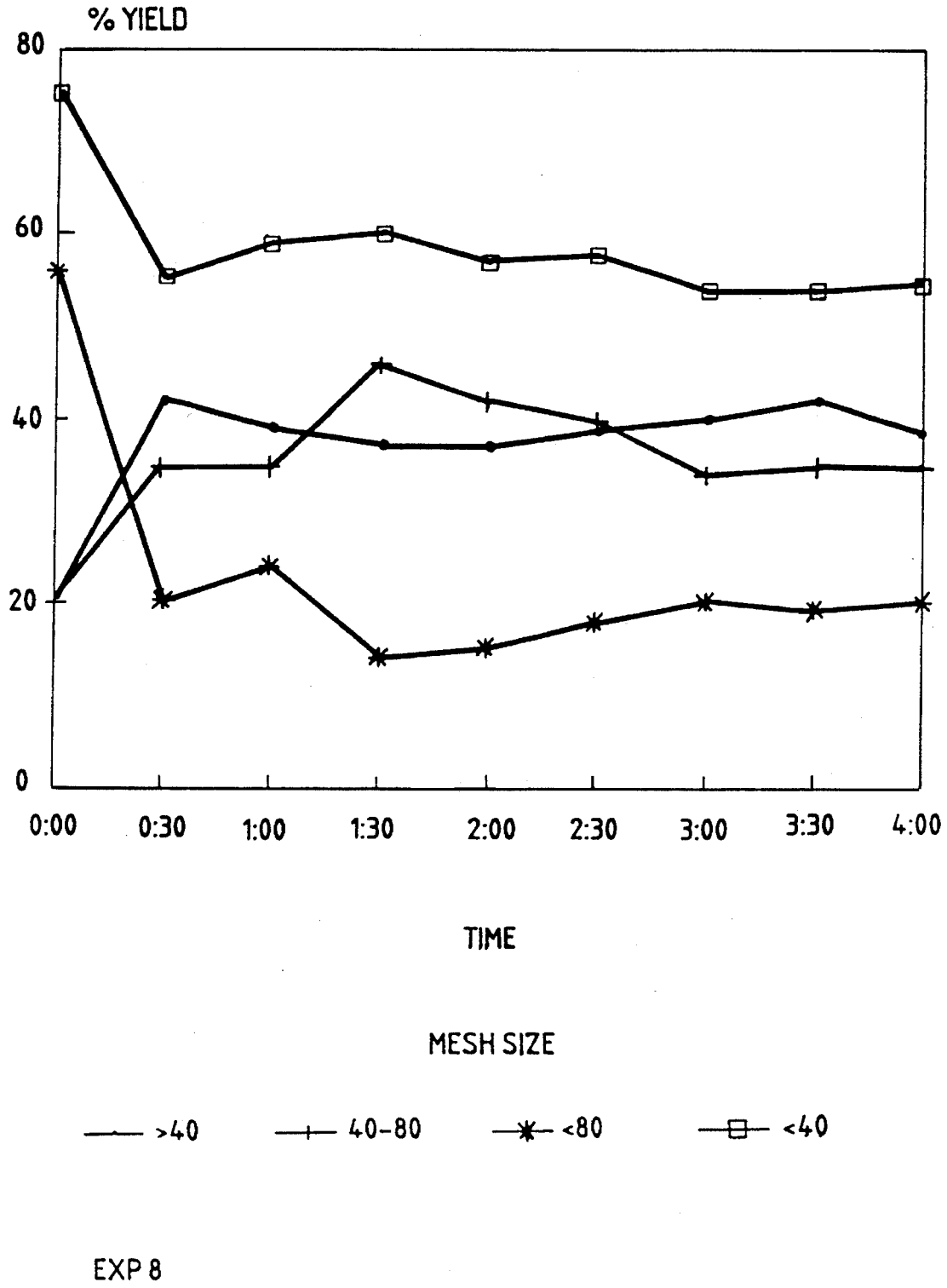
FIG. 8 is a graphical representation of the change in particle size distribution over time during the process of Example 30.

Example 30 (FIG. 8)

Scale up agglomeration with 5% Binder by weight
Binder Composition: $H_2O$.
Particles: Raw.
Size: 200 lbs.

| | Duration in Minutes | | | | | | | | |
|---|---|---|---|---|---|---|---|---|---|
| Distribution | 0 | 30 | 60 | 90 | 120 | 150 | 180 | 210 | 240 |
| Oversize (+40 mesh) | 20% | 42% | 39% | 37% | 37% | 39% | 40% | 42% | 39% |
| Ideal (−40 +80 mesh) | 20% | 35% | 35% | 46% | 42% | 40% | 34% | 35% | 35% |
| Undersize (−80 mesh) | 56% | 20% | 24% | 14% | 15% | 18% | 20% | 19% | 20% |

Figure 9:
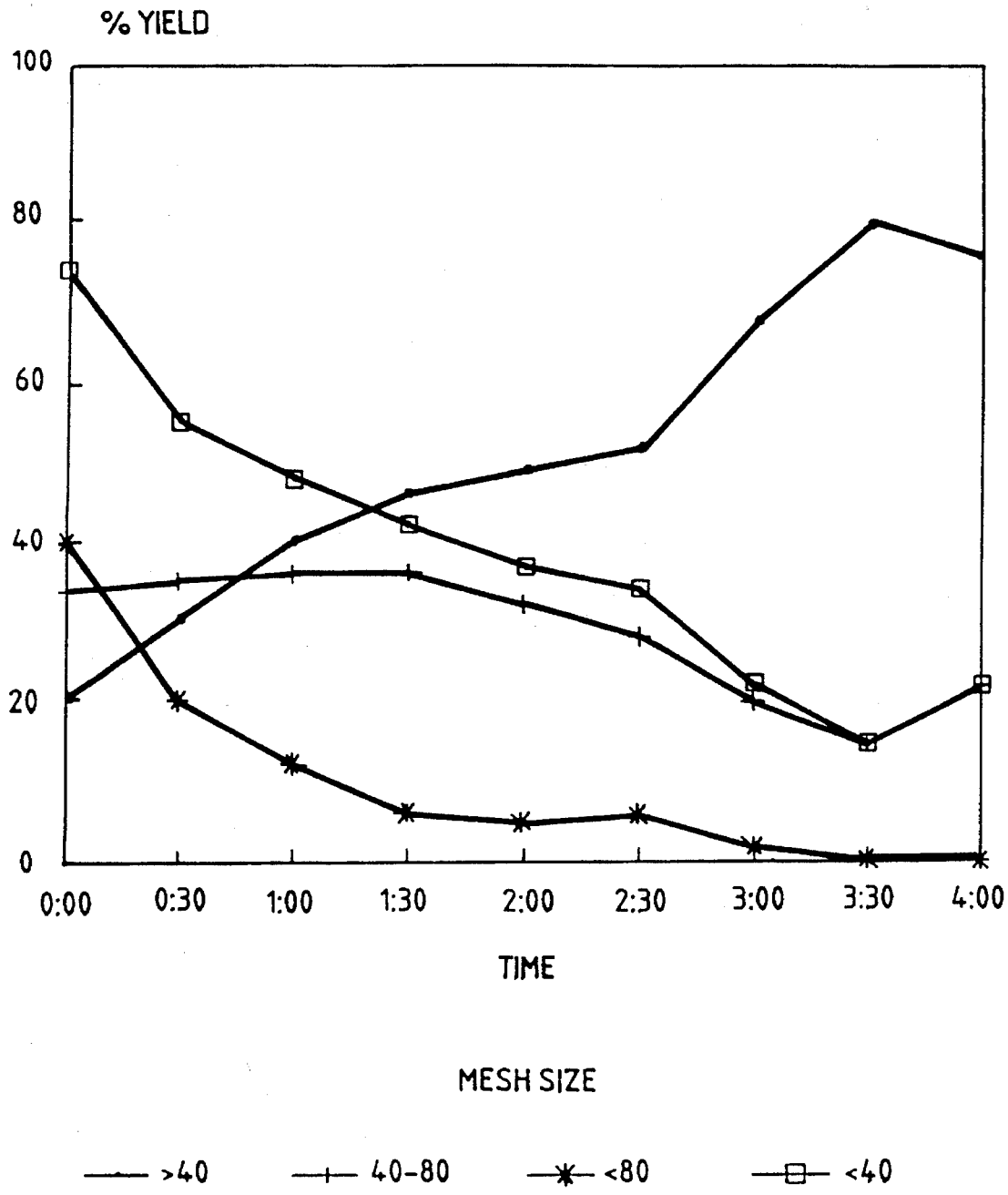
FIG. 9 is a graphical representation of the change in particle size distribution over time during the process of Example 31.

Example 31 (FIG. 9)

Scale up agglomeration with 5% Binder by weight.
Binder Composition:
3% QP300 cellosize + 0.1 Triton N101 + 96.9% $H_2O$ (v/v).
Particles: Raw.
Size: 200 lbs.

| | Duration in Minutes | | | | | | | | |
|---|---|---|---|---|---|---|---|---|---|
| Distribution | 0 | 30 | 60 | 90 | 120 | 150 | 180 | 210 | 240 |
| Oversize (+40 mesh) | 20% | 30% | 40% | 46% | 49% | 52% | 68% | 80% | 76% |
| Ideal (−40 +80 mesh) | 34% | 35% | 36% | 36% | 32% | 28% | 20% | 15% | 22% |
| Undersize (−80 mesh) | 42% | 20% | 12% | 6% | 5% | 6% | 2% | 0% | 0% |

Figure 10:
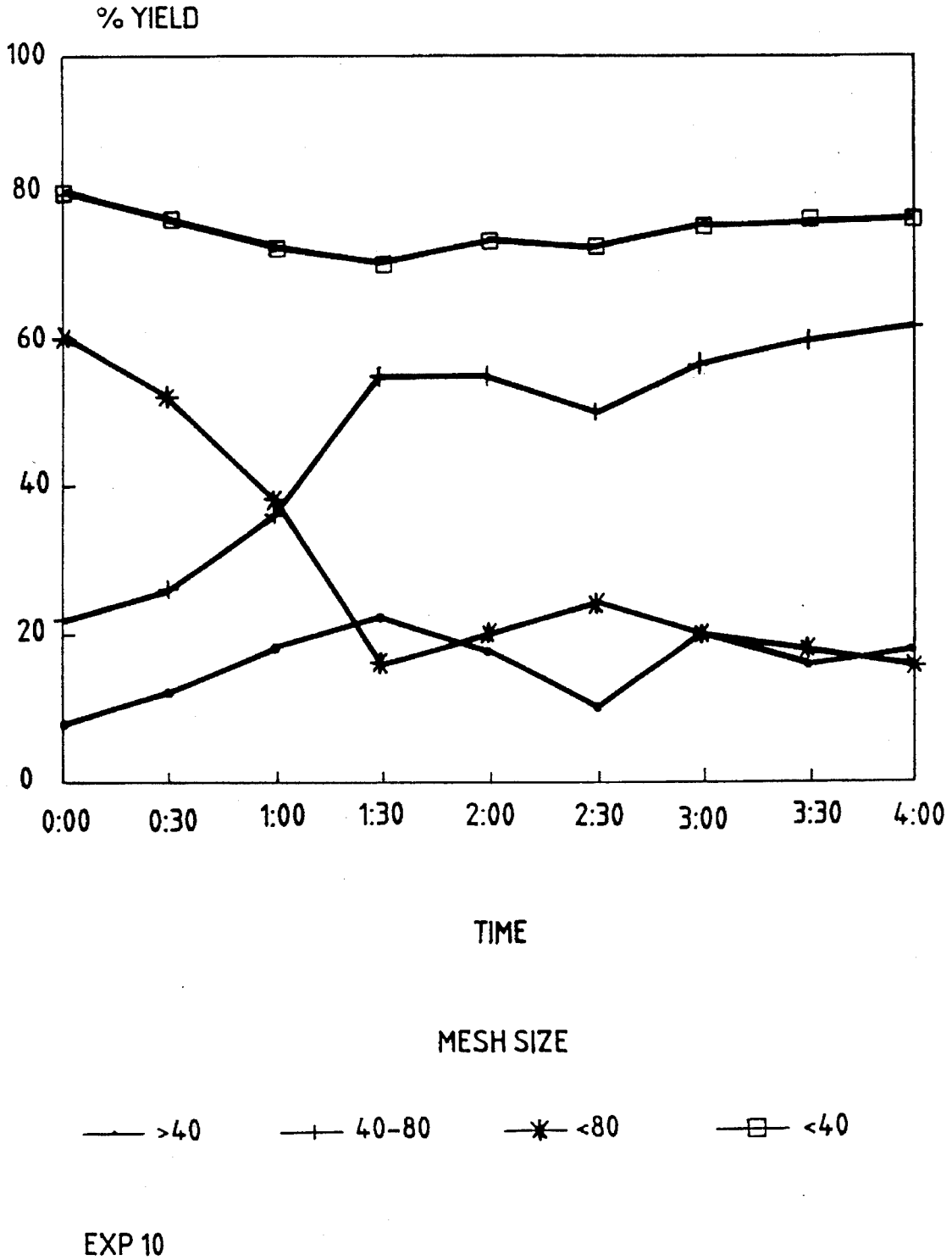
FIG. 10 is a graphical representation of the change in particle size distribution over time during the process of Example 32.

Example 32 (FIG. 10)

Scale up agglomeration with 3% Binder by weight
Binder Composition:
3% QP300 cellosize + 0.1% Triton N101 + 96.9% $H_2O$ (v/v).
Particles: Ground
Size: 200 lbs.

| | Duration in Minutes | | | | | | | | |
|---|---|---|---|---|---|---|---|---|---|
| Distribution | 0 | 30 | 60 | 90 | 120 | 150 | 180 | 210 | 240 |
| Oversize (+40 mesh) | 8% | 12% | 18% | 22% | 18% | 10% | 20% | 16% | 18% |
| Ideal (−40 +80 mesh) | 22% | 26% | 36% | 55% | 55% | 50% | 57% | 60% | 62% |
| Undersize (−80 mesh) | 60% | 52% | 38% | 16% | 20% | 24% | 20% | 18% | 16% |

The process of Example 32 produced a 62% yield of a carrier-free pulverulent lubricant composition having a substantially uniform size. Example 32, relative to Example 31, produced a 40% increase in ideal sized particles when the amount of binder solution was reduced from 5% by weight (Example 31) to 3% by weight (Example 32).

As is apparent from the above, the individual particles of the lubricant composition produced by the agglomeration process are essentially heterogenous in composition, and they are therefore physically different from the particles produced by the dry mix process. They are, moreover, physically different from those produced in both the melt-mix and grind process and the melt-mix and spray dry processes, since agglomerated particles are aggregates of the individual lubricant components which have become fused together into a heterogeneous mass in the absence of a melted matrix. While physically quite different, the lubricant compositions produced by the melt-mix and grind process, and by the agglomeration process, respectively, display no readily observable functional differences; i.e., their performance appears to be equivalent.

Each of the processes of the present invention (whether melt-phase, dried slurry, or agglomerating) is capable of producing individual particles of heterogeneous composition, that have more uniform dielectric properties than a strictly dry-mixed composition.

One advantage of manufacturing the carrier-free pulverulent lubricant composition in a substantially uniform size range is that, when the lubricant particles are sprayed onto the die and workpiece at elevated temperatures, the particles melt and fuse to form a lubricant film which is substantially uniform. Not only are the lubricant components more evenly distributed on the die and workpiece surfaces when the particles are manufactured in this fashion, thus providing improved resistance to sticking and more uniform metal flow along surfaces, but the cleanability of the composition is improved on account of the more uniform distribution of the resins which are included for that purpose. Further, flashing has been eliminated or minimized due to the absence of a carrier.

The process of applying the carrier-free pulverulent lubricant composition of the present invention is carried out at essentially ambient pressure by the use of conventional powder coating equipment. For example, it is well known that, in a conventional electrostatic powder coating apparatus, a fluidized bed of powder feeds a spray wand having an electrode at its tip. While the apparatus injects air into the powder at rather low pressure to form the fluidized bed, by the time the powder reaches the applicator wand tip (typically a distance of about 20 feet), the air carrying the powder (and therefore the powder stream) is at quite low, essentially ambient pressure. The charge imparted to the powder by the electrode provides the acceleration necessary to carry the powder to the die (maintained at ground). Once on the die surface, the lubricant powder may be retained there by the adhesive properties of at least one component included for that purpose.

Alternatively, a conventional powder coating apparatus, whether electrostatic or non-electrostatic, may utilize a gravity-fed conical hopper as a powder source, rather than a fluidized bed. Such an apparatus has been found particularly useful when utilizing lubricant powders of widely varying particle size or relatively heavy lubricant blends, which do not readily form fluidized beds. When such a gravity-fed apparatus is utilized, it has been further found that optimal results in feeding the powder to the spray wand are obtained when the lubricant particles are either substantially spherical in shape or have substantially smooth surfaces, or, most preferably, both. These characteristics permit the lubricant particles to flow more easily, since they will have less tendency to fuse on account of impact or to wedge against one another, thereby blocking flow of material. From the standpoint of optimizing both shape and surface characteristics, the method of manufacture described above which employs spray-drying is the preferred one, since spray-drying inherently produces substantially spherical, substantially smooth particles.

From the standpoint of obtaining substantially uniform particles of heterogeneous composition without the necessity of a melt step, the agglomeration method of the invention is preferred.

In the process of the invention, a coating of the lubricant powder is applied to the workpiece and the die in a fashion much like painting. The lubricant is not worked onto or into the die or workpiece surface. Rather, the process is more akin to painting the lubricant onto the die than to hammering it into the surface.

From the foregoing description and examples, it is apparent that the objects of the present invention have been achieved. While only certain embodiments have been set forth, alternative embodiments and various modifications will be apparent to those skilled in the art. These and other alternatives and modifications are considered equivalents and within the spirit and scope of the present invention.

What is claimed is:

1. A carrier-free pulverulent lubricant composition comprising at least two particulate lubricant components, and at least one of said components being graphite, the particles of said composition consisting essentially of particulate lubricant components which have become fused together in a heterogeneous mass in the substantial absence of a melted matrix.

2. A composition according to claim 1, wherein at least one particulate lubricant component comprises a polymeric resin having a highly polar functional group in the polymer backbone, whereby said resin may be solubilized under strong acid or basic conditions, said resin being a solid at room temperature.

3. A composition according to claim 1, wherein at least one particulate lubricant component is selected from the group consisting of metal soaps, ceramics, natural and synthetic waxes, glasses, fatty acids, and mixtures thereof.

4. A composition according to claim 1, wherein relatively few or no particles are more than 50% larger or smaller than the mean particle size.

5. A composition according to claim 1, wherein the moisture content of the particles is less than 15% by weight.

6. A method of forming a carrier-free pulverulent lubricant composition comprised of at least two particulate lubricant components, and at least one of which is graphite, comprising the steps of:

(a) forming a dry admixture of said particulate lubricant components, and (b) agitating said dry admixture in the presence of an aqueous binder in an amount of up to 5% by weight of the dry admixture whereby particles of said composition are formed from said agitation which consist essentially of particulate lubricant components which have become fused together in a heterogeneous mass in the substantial absence of a melted matrix.

7. The method of claim 6, wherein said admixture of lubricant components comprises at least one solid lubricant selected from the group consisting of metal soaps, ceramics, high melting polymer resins, natural and synthetic waxes, glasses, fatty acids and mixtures thereof.

8. The method of claim 6, wherein said agitating is effected by charging said particulate lubricant components into a vessel and tumbling said vessel by mechanical means.

9. The method of claim 6, wherein said agitating is effected by injecting into said dry admixture a stream of fluidizing gas.

10. The method of claim 6, wherein said binder is added in a spray of finely divided droplets.

11. The method of claim 6, wherein a component of said binder comprises a thickening agent.

12. The method of claim 11, wherein said thickening agent is a member of the group consisting of glyoxal hydroxymethyl cellulose, polyvinylpyrrolidone, xanthan gum, hydroxypropyl methyl cellulose, methyl cellulose, algin, and admixtures thereof.

13. The method of claim 6 wherein said binder comprises a non-ionic surfactant.

14. The method of claim 13, said non-ionic surfactant being present in an amount of from about 0.3% to about 0.1% by weight of said binder.

15. The method of claim 6 wherein the moisture content of said particles is less than about 15% by weight.

16. The method of claim 15 wherein the moisture content of said particles is less than about 5% by weight.

17. The method of claim 6 further comprising the steps of:

passing said particles sequentially through a 40 mesh screen and then through an 80 mesh screen, and retaining the particles that pass through the 40 mesh screen but do not pass through the 80 mesh screen, to provide a carrier-free pulverulent metalworking lubricant of substantially uniform particle size.

18. The method of claim 17 wherein said carrier-free pulverulent lubricant of substantially uniform size has a mean particle diameter of from about 170 microns to about 420 microns.

19. A carrier-free pulverulent lubricant composition according to claim 1 comprising from about 2% to about 30% by weight sulfur, and at least one component having adhesive properties at forging temperatures.

20. A carrier-free pulverulent composition according to claim 1 comprising, by weight, about 5% to about 30% sulfur, and further comprising gilsonite, and polyethylene wax.

21. A carrier-free pulverulent lubricant composition comprising at least two particulate lubricant components, and at least one of said components being a metal soap, the particles of said composition consisting essentially of particulate lubricant components which have become fused together in a heterogeneous mass in the substantial absence of a melted matrix.

* * * * *